US006927743B1

(12) United States Patent
Miller et al.

(10) Patent No.: US 6,927,743 B1
(45) Date of Patent: Aug. 9, 2005

(54) MARINE ANTENNA ARRAY

(75) Inventors: Paul E. Miller, Spring Lake, MI (US); Paul A. Bogdans, Grand Haven, MI (US); Richard A. Conaway, Muskegon, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 0 days.

(21) Appl. No.: 10/605,112

(22) Filed: Sep. 9, 2003

Related U.S. Application Data

(60) Provisional application No. 60/320,176, filed on May 8, 2003.

(51) Int. Cl.[7] ..... H01Q 1/42; H01Q 1/12
(52) U.S. Cl. ..... 343/872; 343/890
(58) Field of Search ..... 343/702, 713, 343/724, 873, 874, 872, 890; 455/703, 168.1, 455/347

(56) References Cited

U.S. PATENT DOCUMENTS

| | | | | |
|---|---|---|---|---|
| 4,694,773 | A | 9/1987 | Sparkes et al. | |
| 5,734,352 | A * | 3/1998 | Seward et al. | 343/722 |
| 6,107,972 | A * | 8/2000 | Seward et al. | 343/722 |
| 6,125,782 | A | 10/2000 | Takashima et al. | |
| 6,198,457 | B1 * | 3/2001 | Walker et al. | 343/840 |
| 6,269,763 | B1 | 8/2001 | Woodland | |
| 6,710,749 | B2 * | 3/2004 | King | 343/757 |
| 2004/0004575 | A1 * | 1/2004 | Tietjen | 343/757 |

OTHER PUBLICATIONS

Englert, Ken; What's Wrong with Electronics Installations; www.docksidemagazine.com; publication date 2000.
Photograph of XS Impulse Speedboat; source unknown; date unknown.
Photograph of antennas on boat; arch source unknown; date unknown.

* cited by examiner

*Primary Examiner*—Don Wong
*Assistant Examiner*—Minh Dieu A
(74) *Attorney, Agent, or Firm*—McGarry Bair PC

(57) ABSTRACT

A marine antenna array includes a contoured antenna assembly having a cowling that houses more than one antenna. Where more than one contoured antenna assembly is required to accommodate all antennas needed on a boat, each contoured antenna assembly is identical in appearance.

12 Claims, 3 Drawing Sheets

MARINE ANTENNA ARRAY

CROSS REFERENCE TO RELATED APPLICATIONS

This application claims the benefit of U.S. Application Ser. No. 60/320,176, filed May 8, 2003.

BACKGROUND OF INVENTION

1. Field of the Invention

The invention relates to antennas and more particularly to marine antennas and mountings for marine antennas.

2. Description of the Related Art

Boats, and particularly pleasure craft, are frequently fitted with a multitude of antennas for a variety of purposes. For example, a single vessel may have antennas for CB, VHF, UHF, TV, AM/FM, cell phone, Orbcomm™ communications, satellite phone, SSB, GPS, and/or a multiband antenna, all in addition to radar. Each antenna has unique design constraints for optimum performance, but one feature common to all is a requirement to receive or transmit at one or more resonant frequencies.

Many marine antennas are mounted to an arch, often called a radar arch or an antenna arch. However, the different designs for the multitude of antennas and different location requirements for optimum performance often leave an antenna arch unsightly with a number of different antennas mounted thereto.

There is a need to provide clean lines and appearance for antenna mountings in marine applications. But no common design accommodates the multitude of antennas available today.

SUMMARY OF INVENTION

A solution is provided by the present invention of a marine antenna array for mounting to a boat. The marine antenna array comprises at least one contoured antenna assembly having a cowling and a base plate. The cowling houses at least two antennas resonant in different frequencies. Where two or more antenna assemblies are used, each will be identical in appearance to the other. Preferably, the cowling is elongated and has a longitudinal axis at an acute angle relative to the baseplate. Also, a portion of one antenna in each assembly can extend from the cowling. Preferably, at least one antenna is a multi-band antenna.

In another aspect of the invention, an improvement is a marine vessel having a mounting platform for antennas. The improvement comprises an array of at least two antenna assemblies, each antenna assembly having a cowling. Each cowling at least partially encloses an antenna. The cowlings and visible portions of the antenna assemblies look identical. A cowling can enclose more than one antenna. Preferably, the mounting platform is an arch and the cowlings are raked relative to the mounting platform.

The cowlings can be elongated where each has a longitudinal axis at an acute angle relative to the baseplate. Typically, a portion of each antenna extends from its respective cowling. Also, at least one antenna is preferably a multiband antenna. The result of the invention is an aesthetically pleasing look with clean lines and a minimal number of projections from the arch.

DETAILED DESCRIPTION

Figure 1:
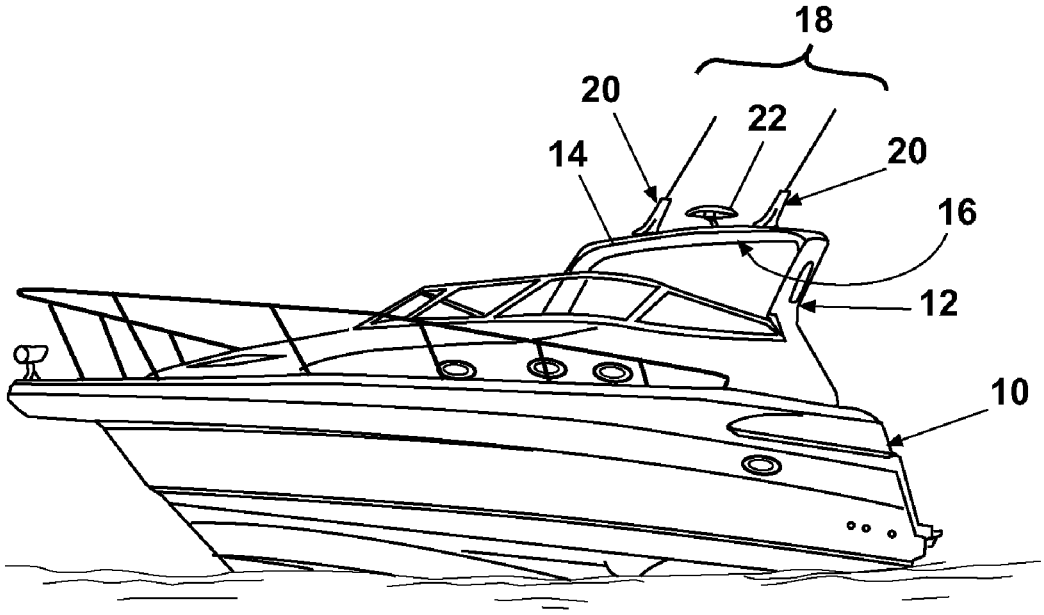
FIG. 1 is a perspective view of a boat having a marine antenna array according to the invention.

FIG. 1 shows a boat 10 having an arch 12. As is conventional in marine architecture, the arch is often multi-functional. For example, it may house lighting, sound components for an audio system, rigging accessories, and provide anchors for cover attachments. With respect to the invention, however, the arch 12 is a mounting platform, having an upper surface 14 on a crosspiece 16 that provides support for an antenna array 18 according to the invention.

Figure 3:
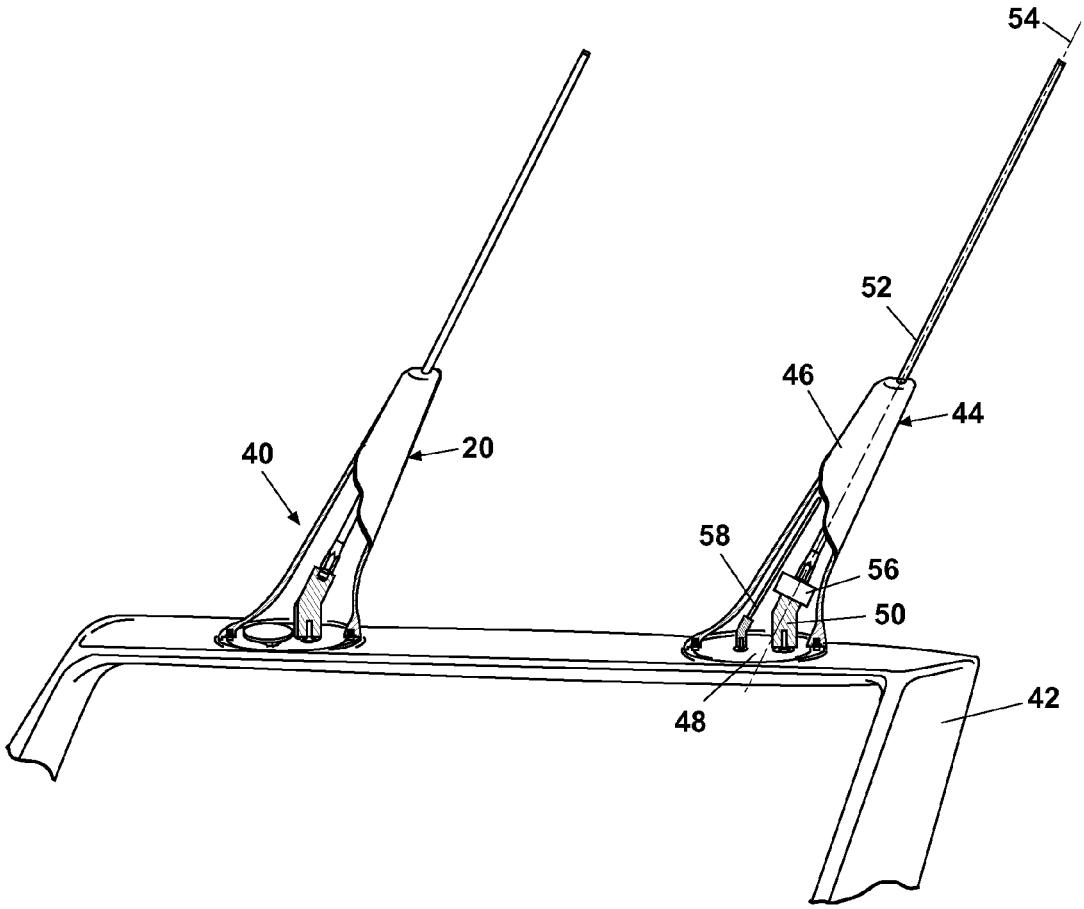
FIG. 3 is a perspective view of an antenna arch having an antenna array according to the invention, with portions broken away.

The antenna array 18 comprises at least one contoured antenna assembly 20. Where more than one contoured antenna assembly 20 is provided, as shown in FIGS. 1 and 3, each is identical in appearance and orientation relative to the boat 10. The contoured antenna assembly 20 will comprise at least one antenna, and preferably more than one antenna. Each of CB, VHF, UHF, TV, AM/FM, cell phone, Orbcomm™ communications, satellite phone, SSB, GPS, and/or a multiband antenna can be configured to fit mostly within the contoured antenna assembly 20. Depending on the shape and size of the contoured antenna assembly 20, a radar antenna may also be configured to fit within the contoured antenna assembly. More likely, however, a radar dome 21 having its own configuration and contour will be separate from the contoured antenna assembly 20.

Figure 2:
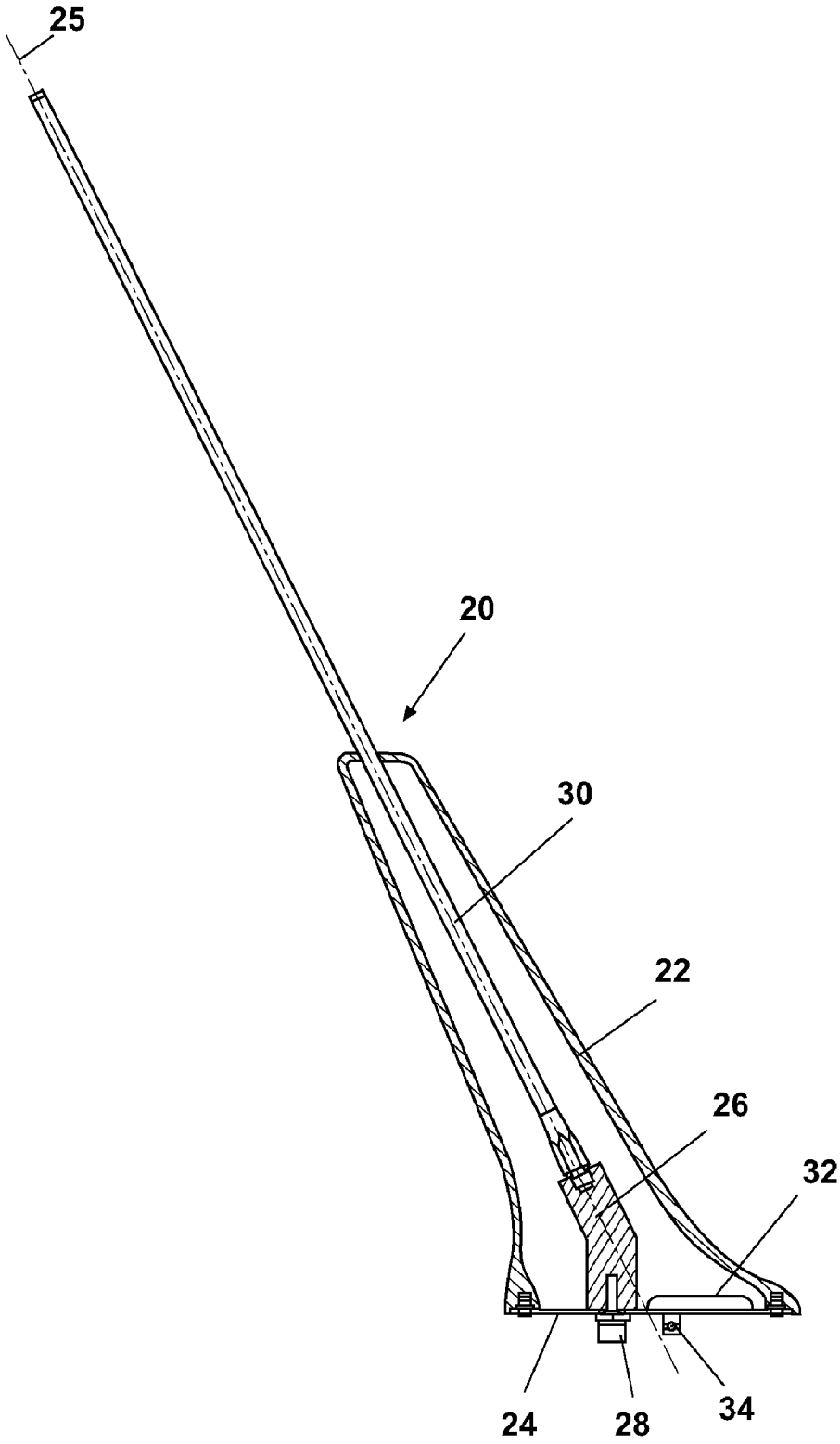
FIG. 2 is a plan view, with portions broken away, of a single antenna housing in the array of FIG. 1.

Looking now also at FIG. 2, an embodiment of the contoured antenna assembly 20 is illustrated. The assembly 20 comprises a cowling 22 attached to a baseplate 24. Preferably, the cowling is made of a durable polymer and colored to aesthetically match or complement the arch. Within the cowling 22, a fixture 26 is secured to the baseplate 24. An antenna connector 28 projects from the fixture 26 through the baseplate 24. The cowling 22 in this embodiment is shaped to have a rake to it so that it has a longitudinal axis 25 that is not normal to the baseplate 24. The rake angle is mostly ornamental, offering an appearance of speed. However, it will be apparent that the greater the rake angle, the less the contoured antenna assembly 20 will project above the arch 12 to which is mounted.

An antenna 30 is mounted to the fixture 26 and projects through the cowling 22, generally along the longitudinal axis. The antenna 30 is preferably a multiband antenna, capable of resonating at more than one frequency. For example, the antenna 30 may be capable of receiving signals in the CB, AM/FM, and cell phone frequency ranges, as disclosed in U.S. Pat. No. 5,734,352, the disclosure of which is incorporated herein by reference. Processing circuitry (not shown) may be disposed within the arch or elsewhere to separate the different frequencies. A GPS antenna 32 is mounted to the baseplate 24 and has a connector 34 extending therethrough. The baseplate 24 is secured to the upper surface 14 of the arch 12 in a conventional manner, with the connectors 28, 34 connecting to appropriate leads to the processing circuitry for processing signals received by the respective antennas 30, 32.

FIG. 3 illustrates an embodiment of an antenna array 40 on an antenna arch 42 according to the invention. The antenna array comprises the contoured antenna assembly 20 of FIG. 2 mounted to the arch 42 as described above. In addition, a second contoured antenna assembly 40 has an exterior configuration similar or identical to the contoured antenna assembly 20. The second contoured antenna assembly 44 is mounted to the arch 42 spaced from the first contoured antenna assembly 20 and oriented to have the same rake angle as the contoured antenna assembly 20. The second contoured antenna assembly 44 comprises a cowling 46 and a baseplate 48 to which the cowling 46 is attached. Within the cowling 46, a fixture 50 is secured to the baseplate 48. A second multiband antenna 52 extends along a longitudinal axis 54 from the fixture 50, along with a circuit box 56 for isolating frequencies received by the antenna 52. Like the antenna assembly 20, the antenna 52 extends from the cowling 46, if not by reason of the electrical length of the antenna itself, then by reason of matching the visual appearance of the antenna assembly 20. In addition a monopole antenna 58 is located within the cowling 46 for receiving a specific frequency.

While the invention has been specifically described in connection with certain specific embodiments thereof, it is to be understood that this is by way of illustration and not of limitation, and the scope of the appended claims should be construed as broadly as the prior art will permit.

What is claimed is:

1. A marine antenna array for mounting to a boat, the marine antenna array comprising at least one contoured antenna assembly having a cowling and a base plate, wherein the cowling houses at least two antennas resonant in different frequencies.

2. A marine antenna array according to claim 1 comprising at least two contoured antenna assemblies, each of which is identical in appearance to the other.

3. A marine antenna array according to claim 1 wherein the cowling is elongated and has a longitudinal axis at an acute angle relative to the baseplate.

4. A marine antenna array according to claim 1 wherein a portion of one antenna extends from the cowling.

5. A marine antenna array according to claim 1 wherein at least one antenna is a multiband antenna.

6. In a marine vessel having a mounting platform for antennas, the improvement comprising an array of at least two antenna assemblies, each antenna assembly having a cowling at least partially enclosing an antenna wherein the cowlings and visible portions of the antenna assemblies look identical.

7. The improvement of claim 6 wherein at least one of the cowlings at least partially encloses more than one antenna.

8. The improvement of claim 6 wherein the mounting platform is an arch.

9. The improvement of claim 6 wherein the cowlings are raked relative to the mounting platform.

10. The improvement of claim 6 wherein the cowlings are elongated and each has a longitudinal axis at an acute angle relative to the baseplate.

11. The improvement of claim 6 wherein a portion of each antenna extends from the respective cowling.

12. The improvement of claim 6 wherein at least one antenna is a multiband antenna.

* * * * *